US011739895B1

(12) United States Patent
Zheng

(10) Patent No.: US 11,739,895 B1
(45) Date of Patent: Aug. 29, 2023

(54) LED STREET LIGHT

(71) Applicant: Shenzhen Long Sun Optoelectronics Technology Co., Ltd., Shenzhen (CN)

(72) Inventor: Zebin Zheng, Shenzhen (CN)

(73) Assignee: SHENZHEN LONG SUN OPTOELECTRONICS TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 18/061,473

(22) Filed: Dec. 4, 2022

(51) Int. Cl.

| | |
|---|---|
| ***F21S 8/08*** | (2006.01) |
| ***F21V 21/108*** | (2006.01) |
| ***F21V 19/00*** | (2006.01) |
| ***F21V 31/00*** | (2006.01) |
| ***F21V 21/26*** | (2006.01) |
| ***F21W 131/103*** | (2006.01) |
| ***F21Y 115/10*** | (2016.01) |

(52) U.S. Cl.
CPC ..... *F21S 8/086* (2013.01); *F21V 19/0045* (2013.01); *F21V 21/108* (2013.01); *F21V 21/26* (2013.01); *F21V 31/005* (2013.01); *F21W 2131/103* (2013.01); *F21Y 2115/10* (2016.08)

(58) Field of Classification Search
None
See application file for complete search history.

(56) References Cited

U.S. PATENT DOCUMENTS

2005/0117338 A1* 6/2005 Kratz ..... F21V 21/002 362/183

FOREIGN PATENT DOCUMENTS

| | | | | |
|---|---|---|---|---|
| BR | 102018068519 A2 * | 3/2020 | | |
| CN | 201487864 U | 5/2010 | | |
| CN | 110542037 A | 12/2019 | | |
| CN | 215294656 U | 12/2021 | | |
| WO | 2015176605 A1 | 11/2015 | | |
| WO | WO-2018204313 A1 * | 11/2018 | ..... | F21S 8/086 |

OTHER PUBLICATIONS

Yeo Mi Young, "Connecting System of Streetlight", Apr. 22, 2009, KR-20090038950-A with merged English text, pp. 1-6. (Year: 2009).*

Anteya Technology Corporation, "Lighting Device of Strip-shaped Light-emitting Diode Lamps", Nov. 20, 2008, DE-202008012317-U1 with merged English text, pp. 1-18. (Year: 2008).*

* cited by examiner

*Primary Examiner* — Alan B Cariaso
(74) *Attorney, Agent, or Firm* — Andrew C. Cheng

(57) ABSTRACT

The invention relates to the technical field of lighting, more particularly to a LED street light that includes a main body and a support arm connected to the main body. A female joint is provided at one end of the support arm close to the main body. A male joint is provided at one end of the main body close to the support arm. When installing the LED street light, the male joint and the female joint are mutually inserted to supply power to the main body, without arranging the circuits in the LED street light before installation, which greatly simplifies the installation process and reduces the installation time and the installation difficulty. In addition, due to the reduction of the installation time and installation difficulty, the safety hazards caused by the installation of the LED street lights can also be prevented, and safety is thus improved.

17 Claims, 4 Drawing Sheets

LED STREET LIGHT

TECHNICAL FIELD OF THE INVENTION

The present invention relates to the technical field of lighting, more particularly to a LED street light.

BACKGROUND OF THE INVENTION

The existing street lights, when installing, are required to pass the wires through the corresponding wire holes, and then install the main body thereof, which is complicated, and may bring safety hazards to the installer at high altitudes during installation due to the complex installation process and long installation time. In addition, when repairing street lights, the installer has to disassemble the main body of the street light to check the fault. Due to the complicated installation of street lights, the disassembly process thereof is also complicated, time-consuming and labor-intensive, and there are potential safety hazards.

SUMMARY OF THE INVENTION

In order to solve the problem of complicated installation of the existing street lights, the present invention provides a LED street light.

In order to solve the technical problem above, the present invention provides a LED street light, which includes a main body and a support arm connected to the main body. A female joint is provided at one end of the support arm close to the main body. A male joint is provided at one end of the main body close to the support arm. When installing the LED street light, the male joint and the female joint are mutually inserted to achieve an electrical connection therebetween.

Preferably, a first docking portion is provided at one end of the support arm close to the main body. The first docking portion defines a first accommodating slot with an opening, and the female joint is disposed in the first accommodating slot. A second docking portion docked with the first docking portion is provided at one end of the main body close to the support arm. The second docking portion defines a second accommodating slot with an opening, and the male joint is disposed in the second accommodating slot.

Preferably, the shape of the opening of the first accommodating slot corresponds to that of the opening of the second accommodating slot.

Preferably, when the first docking portion is docked with the second docking portion, the opening of the first accommodating slot is matched and docked with the opening of the second accommodating slot.

Preferably, the orientation of the opening of the first accommodating slot is opposite to the lighting direction of the LED street light. The orientation of the opening of the second accommodating slot is the same as the lighting direction of the LED street light.

Preferably, when the first docking portion is docked with the second docking portion, the first docking portion is inserted into the second docking portion or the second docking portion is inserted into the first docking portion.

Preferably, a waterproof ring is provided between the first accommodating slot and the second accommodating slot.

Preferably, a clamping slot is defined on the slot wall of the first accommodating slot, when installing the LED street light, the side wall of the second accommodating slot enters the clamping slot such that the opening of the first accommodating slot is matched and docked with the opening of the second accommodating slot; or a clamping slot is defined on the side wall of the second accommodating slot, when installing the LED street light, the slot wall of the first accommodating slot enters the clamping slot such that the opening of the first accommodating slot is matched and docked with the opening of the second accommodating slot.

Preferably, the waterproof ring is disposed in the clamping slot.

Preferably, the waterproof ring is in an interference fit with the clamping slot.

Preferably, the thickness of the waterproof ring is less than the depth of the clamping slot.

Preferably, an abutting portion is defined on an edge, formed by the bottom wall extending in a direction away from the second accommodating slot, of the bottom wall, and the slot bottom of the first accommodating slot extends along a direction away from the first accommodating slot such that there is a distance formed between an edge of the slot bottom of the first accommodating slot and the slot wall of the first accommodating slot. During the installation of the LED street light, the abutting portion abuts the edge of the slot bottom of the first accommodating slot to limit the movement of the second docking portion.

Preferably, the abutting portion is U-shaped.

Preferably, the cross-section of the abutting portion is L-shaped.

Preferably, two limiting members are respectively provided at two opposite sides outside the first accommodating slot, and two limiting slots, that cooperate with the limiting members, are respectively defined at two opposite sides outside the second accommodating slot. When installing the LED street light, the limiting member enters the limiting slot.

Preferably, a limiting wall is provided at one side of the limiting slot, the first docking portion is also provided with a limiting plate, and a limiting opening is defined between the limiting plate and the limiting member. When installing the LED street light, the limiting wall enters the limiting opening.

Preferably, the support arm includes an adjusting arm and a fixed arm detachably connected to the adjusting arm. The first docking portion is disposed on the adjusting arm, and the adjusting arm is used to adjust the lighting angle of the LED street light.

Preferably, a first engaging portion is provided at one side of the adjusting arm, and a second engaging portion is provided on the fixed arm corresponding to the first engaging portion. The lighting angle of the LED street light can be changed by rotating the first engaging portion and/or the second engaging portion to adjust the matching position of the first engaging portion and the second engaging portion.

Preferably, a dial is provided on one side opposite to the first engaging portion of the adjusting arm, and the dial is used to illustrate the lighting angle of the LED street light.

Preferably, the first docking portion defines bolt holes on two opposite sides outside the first accommodating slot, and the second docking portion correspondingly defines matching portions matched with the bolt holes. After the first docking portion and the second docking portion are docked, the bolt holes and the matching portion are fixed by means of bolts to connect the first docking portion with the second docking portion.

Compared with the prior art, the LED street light of the present invention has the following beneficial effects.

The LED street light of the present invention includes a main body and a support arm connected to the main body; a female joint is provided at one end of the support arm close to the main body, and a male joint is provided at one end of the main body close to the support arm; when installing the LED street light, the male joint and the female joint are mutually inserted to achieve an electrical connection therebetween; when installing the LED street light, the male joint and the female joint are mutually inserted to supply power to the main body, without arranging the circuits in the LED street light before installation, which greatly simplifies the installation process, reduces the installation time and the installation difficulty; in addition, due to the reducing of the installation time and installation difficulty, the safety hazards caused by the installation of the LED street lights can also be prevented; furthermore, when the LED street light needs to be repaired or maintained, it is simpler and more convenient to disassemble the main body, which saves manpower and is safer.

A first docking portion is provided at one end of the support arm close to the main body, the first docking portion defines a first accommodating slot with an opening, and the female joint is disposed in the first accommodating slot; a second docking portion docked with the first docking portion is provided at one end of the main body close to the support arm, the second docking portion defines a second accommodating slot with an opening, and the male joint is disposed in the second accommodating slot; when the first docking portion is docked with the second docking portion, the opening of the first accommodating slot is matched and docked with the opening of the second accommodating slot.

The female joint is disposed in the first accommodating slot, which can protect and centrally manage the female joint, improve the safety of the female joint, and facilitate the maintenance of the female joint; the male joint is disposed in the second accommodating slot, which can protect and centrally manage the male joint, improve the safety of the male joint, and facilitate the maintenance of the male joint; in addition, after the first docking portion is docked with the second docking portion, the opening of the first accommodating slot matches the opening of the second accommodating slot to form a closed space to seal and protect the male joint and the female joint therein, such that the structure thereof is simple, stable and safe.

A clamping slot is defined on the slot wall of the first accommodating slot, when installing the LED street light, the side wall of the second accommodating slot enters the clamping slot such that the opening of the first accommodating slot is matched and docked with the opening of the second accommodating slot; or a clamping slot is defined on the side wall of the second accommodating slot, when installing the LED street light, the slot wall of the first accommodating slot enters the clamping slot such that the opening of the first accommodating slot is matched and docked with the opening of the second accommodating slot; the cooperation between the slot wall and the clamping slot can improve the sealing performance of the closed space formed after the opening of the first accommodating slot and the opening of the second accommodating slot are matched, such that the stability of the structure thereof is improved, and the safety of the male joint and the female joint is improved.

A waterproof ring is provided in the clamping slot of the present invention, which can further seal and protect the male joint and the female joint, such that when the LED street light is in use, the male joint and the female joint are completely isolated from the water vapor in the air, which further improves the stability of the structure thereof.

An abutting portion is defined on the edge formed by the bottom wall extending in a direction away from the second accommodating slot, and the slot bottom of the first accommodating slot extends along a direction away from the first accommodating slot such that there is a distance formed between the edge of the slot bottom and the slot wall; when installing the LED street light, the abutting portion abuts the edge of the slot bottom to limit the movement of the second docking portion, such that the main body can be positioned to improve the installation convenience thereof.

The abutting portion of the present invention is U-shaped, which can abut three edges of the slot bottom, such that the positioning thereof is accurate and stable.

In the present invention, two limiting members are respectively provided at two opposite sides outside the first accommodating slot, and two limiting slots, that cooperate with the limiting members, are respectively defined at two opposite sides outside the second accommodating slot; when installing the LED street light, the limiting member enters the limiting slot; the cooperation of the limiting member and the limiting slot can locate the connecting portion thereof when installing the LED street light, and can locate the insertion position of the male joint and the female joint, which further improves the convenience of installation.

One side of the limiting slot of the present invention is provided with a limiting wall, and a limiting plate is also provided on the first docking portion, and a limiting opening is defined between the limiting plate and the limiting member; when installing the LED street light, the limiting wall enters the limiting opening; the cooperation of the limiting wall and the limiting opening can achieve accurate positioning and improve the convenience of installation.

The support arm of the present invention includes a fixed arm and an adjusting arm detachably connected to the fixed arm, and the first docking portion is disposed on the adjusting arm; the lighting angle of the main body can be adjusted by adjusting the adjusting arm such that the operation is simple and convenient.

A first engaging portion and a dial are respectively provided on opposite sides of the adjusting arm, and a second engaging portion is provided on the fixed arm corresponding to the first engaging portion; the lighting angle of the LED street light can be changed by rotating the first engaging portion and/or the second engaging portion to adjust the matching position of the first engaging portion and the second engaging portion, and the lighting angle of the LED street light can be visually observed through the dial, such that the operation is easy and the structure is simple, which can further reduce the installation difficulty of the LED street light and meet the various lighting needs of the LED street light.

BRIEF DESCRIPTION OF DRAWINGS

In order to illustrate the technical solutions in the embodiments of the present invention more clearly, the following briefly introduces the accompanying drawings that need to be used in the description of the embodiments or the prior art. Obviously, the drawings in the following description are merely some embodiments of the present invention, for those of ordinary skill in the art, other drawings can also be obtained according to these drawings without any creative effort.

NUMERICAL REFERENCE IDENTIFICATION

Figure 1:
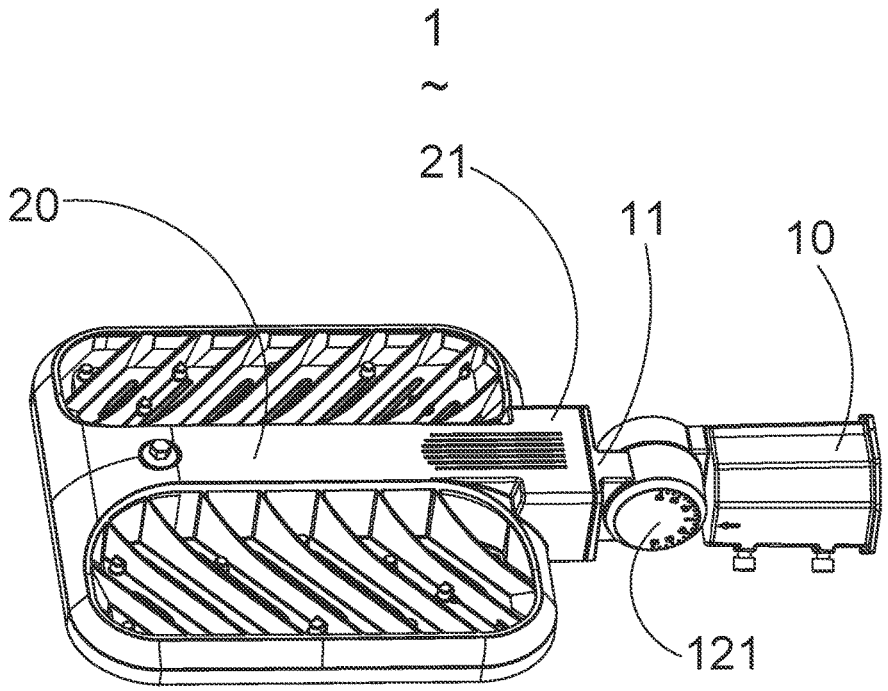
FIG. 1 is a perspective view of a LED street light of a first embodiment of the present invention.

1, LED street light;

10, support arm; 11, first docking portion; 12, adjusting arm; 13, fixed arm; 20, main body; 21, second docking portion;

110, first accommodating slot; 111, slot bottom; 112, slot wall; 113, female joint; 114, limiting plate; 115, limiting opening; 117, limiting member; 120, first engaging portion; 121, dial; 130, second engaging portion; 140, bolt hole; 210, second accommodating slot; 211, bottom wall; 212, side wall; 213, male joint; 214, clamping slot; 215, waterproof ring; 216, abutting portion; 217, limiting slot; 218, limiting wall.

DETAILED DESCRIPTION OF THE INVENTION

In order to make the objectives, technical solutions and advantages of the present invention clearer, the present invention will be further described in detail below with reference to the accompanying drawings and embodiments. It should be understood that the specific embodiments described herein are only used to explain rather than limit the present invention.

It should be noted that when an element is referred to as being "fixed to" another element, the element can be directly on the other element or intervening elements may also exist. When an element is referred to as being "connected" to another element, the element can be directly connected to the other element or intervening elements may also exist. The terms "vertical", "horizontal", "left", "right" and similar expressions are used herein for illustration only.

In the present invention, the orientation or positional relationship indicated by the terms "on", "below", "left", "right", "front", "rear", "top", "bottom", "in", "out", "middle", "vertical", "horizontal", "horizontal", "longitudinal", etc. is based on the orientation or positional relationship shown in the drawings. These terms are primarily used to better describe the invention and the embodiments thereof but are not intended to limit the fact that the indicated device, element or component must have a particular orientation, or be constructed and operated in a particular orientation.

In addition, some of the above-mentioned terms may be used to express other meanings besides orientation or positional relationship. For example, the term "on" may also be used to express a certain attachment or connection relationship in some cases. For those of ordinary skill in the art, the specific meanings of these terms in the present invention can be understood according to specific situations.

Furthermore, the terms "install", "dispose", "provide", "connect", etc. should be construed broadly. For example, it may be a fixed connection, a detachable connection, or a unitary structure; it may be a mechanical connection or an electrical connection; it may be a direct connection, or an indirect connection through an intermediary, or an internal communication between two devices, elements or components. For those of ordinary skill in the art, the specific meanings of the above terms in the present invention can be understood according to specific situations.

Figure 2:
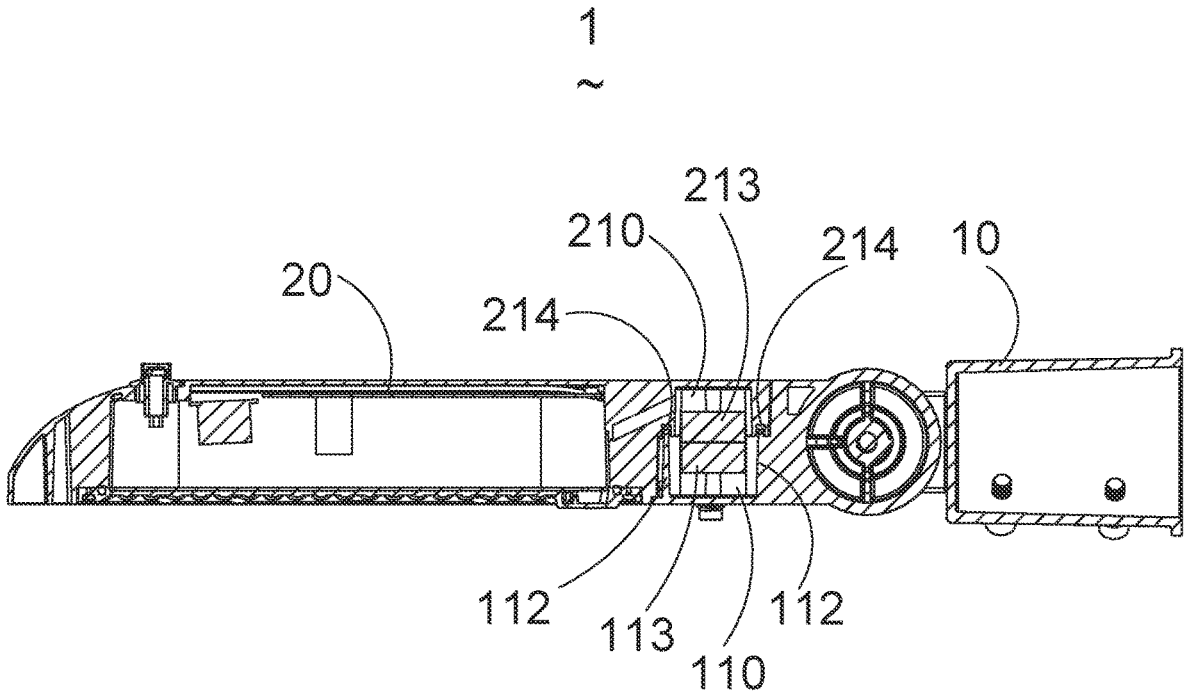
FIG. 2 is a cross-sectional view of the LED street light of the first embodiment of the present invention.

Referring to FIGS. 1 and 2, a first embodiment of the present invention provides a LED street light 1, which includes a main body 20 and a support arm 10 connected to the main body 20. A female joint 113 is provided at one end of the support arm 10 close to the main body 20. A male joint 213 is provided at one end of the main body 20 close to the support arm 10. When installing the LED street light 1, the male joint 213 and the female joint 113 are mutually inserted to achieve an electrical connection therebetween.

Further, the LED street light 1 is provided with a control module. The control module can be disposed in the main body 20 or in the support arm 10. The male joint 213 and the female joint 113 may also include signal terminals that cooperate with each other. The signal terminals are connected with the control module to transmit signals to the control module to intelligently control the LED street light 1. The intelligent control of the LED street light 1 may be a known control method such as voice control, light control and induction control.

Further, a first docking portion 11 is provided at one end of the support arm 10 close to the main body 20. A second docking portion 21, which is docked with the first docking portion 11, is provided at one end of the main body 20 close to the support arm 10. The female joint 113 is disposed on the first docking portion 11, and the male joint 213 is disposed on the second docking portion 21. When installing the LED street light 1, the first docking portion 11 and the second docking portion 21 are matched and connected, such that the main body 20 and the support arm 10 are stably connected while the female joint 113 and the male joint 213 are electrically connected. Thus, the structure is simple, the operation is easy, and the installation efficiency is greatly improved.

The male joint 213 is fixed in the main body 20 and connected to circuits inside the main body 20, and the female joint 113 is fixed in the support arm 10 and connected to an external power supply via circuits. When installing the LED street light 1, the male joint 213 and the female joint 113 are mutually inserted, similar to form of a plug and a socket, to supply power to the main body 20, without arranging the circuits in the LED street light 1 before installation, which greatly simplifies the installation process, reduces the installation time and the installation difficulty. In addition, high-altitude work is required when installing the LED street light 1, if the installation time is too long, the physical strength of the installer will be greatly consumed, which may have potential safety hazards. The installation process of the LED street light 1 of the present invention is very simple, which greatly shortens the installation time and improves the safety during the installation of the LED street light 1. Furthermore, when the LED street light 1 needs to be repaired or maintained, it is simpler and more convenient to disassemble the main body 20, which saves manpower and is safer.

When installing the LED street light 1, the support arm 10 is fixed first, and then the second docking portion 21 of the main body 20 is aligned with the first docking portion 11 of the support arm 10. The stability of the docking between the second docking portion 21 and the first docking portion 11 can be improved through the corresponding engaging structures therein. Finally, the two docking portions are fixed by bolts to enhance the stable connection between the main body 20 and the support arm 10.

Figure 3:
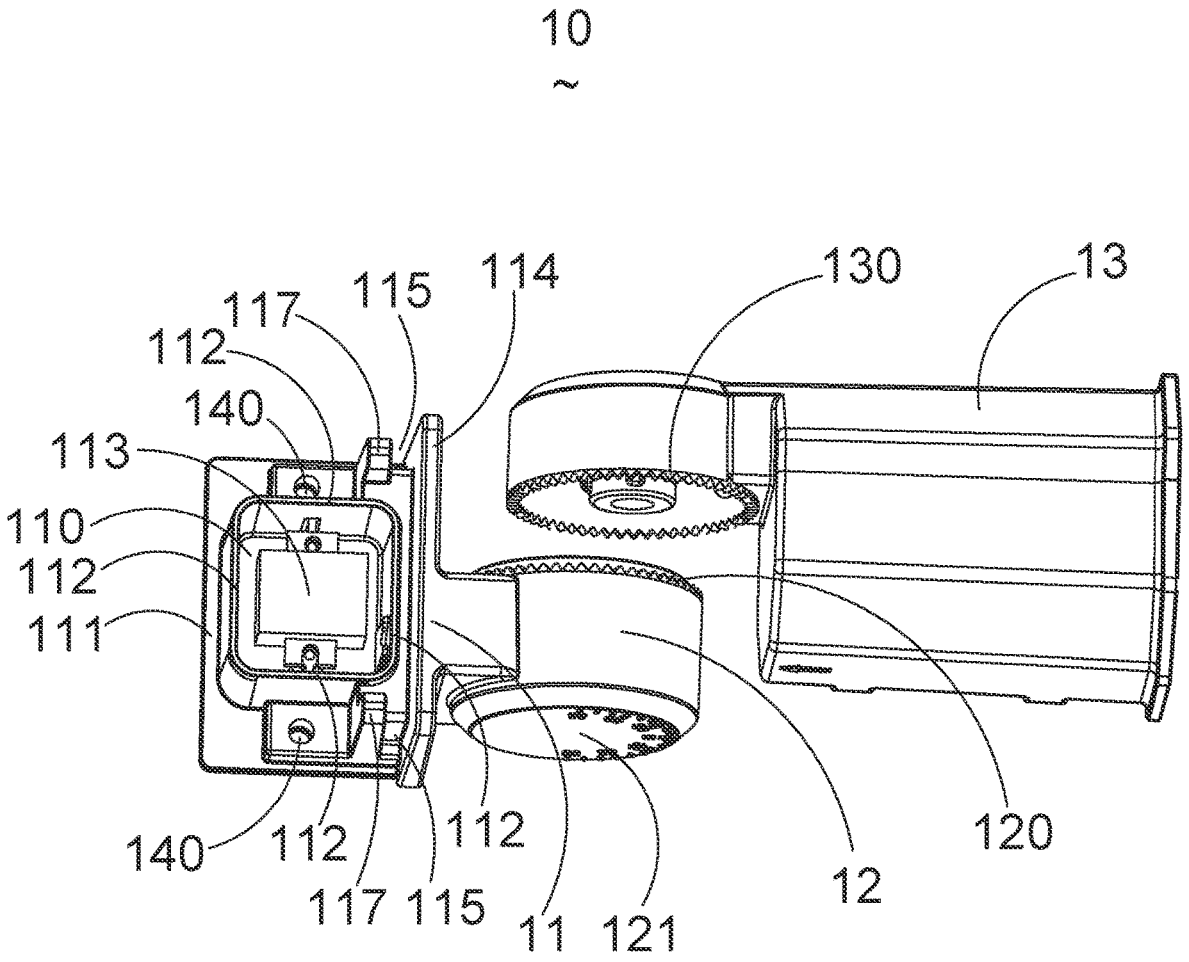
FIG. 3 is an exploded view of a support arm of the LED street light of the first embodiment of the present invention.
Figure 4:
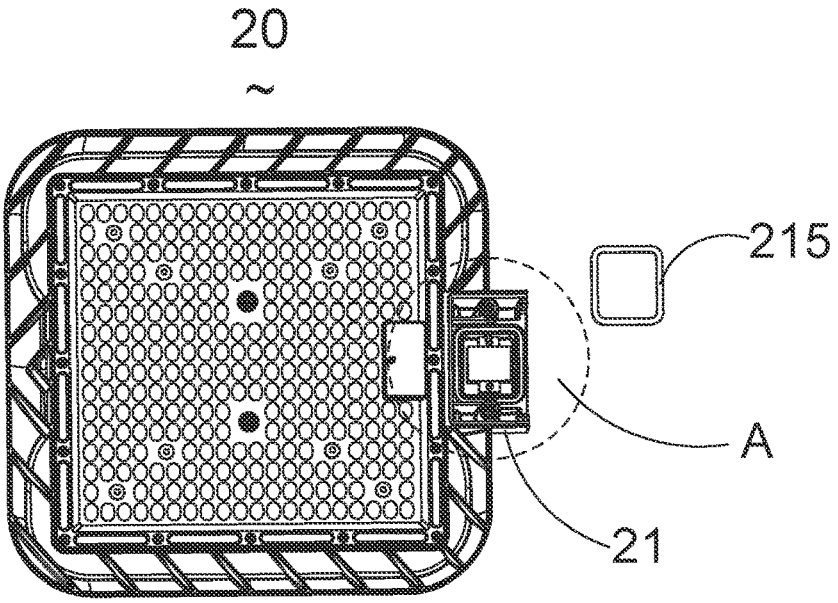
FIG. 4 is an exploded view of a main body of the LED street light of the first embodiment of the present invention.

Further, referring to FIGS. 1 and 3, the support arm 10 includes an adjusting arm 12 and a fixed arm 13 detachably connected to the adjusting arm 12. The first docking portion 11 is disposed on the adjusting arm 12, and the adjusting arm 12 can be used to adjust the lighting angle of the LED street light 1.

Further, a first engaging portion 120 and a dial 121 are respectively provided on opposite sides of the adjusting arm 12, and a second engaging portion 130 is provided on the fixed arm 13 corresponding to the first engaging portion 120. The lighting angle of the LED street light 1 can be changed by rotating the first engaging portion 120 and/or the second engaging portion 130 to adjust the matching position of the first engaging portion 120 and the second engaging portion 130, and the lighting angle of the LED street light 1 can be visually observed through the dial 121. Thus, the structure is simple, stable and has strong operability, which greatly improves the practicability of the LED street light 1.

Referring to FIGS. 2 to 5, further, in order to improve the safety of the female joint 113 and the male joint 213, the first docking portion 11 defines a first accommodating slot 110 with an opening, and the female joint 113 is disposed in the first accommodating slot 110. The first accommodating slot 110 includes a slot bottom 111, four slot walls 112 connected to the slot bottom 111, and a first opening opposite to the slot bottom 111. The orientation of the first opening is opposite to the lighting direction of the LED street light 1. Similarly, the second docking portion 21 defines a second accommodating slot 210 with an opening, and the male joint 213 is disposed in the second accommodating slot 210. The second accommodating slot 210 includes a bottom wall 211, four side walls 212 connected to the bottom wall 211, and a second opening opposite the bottom wall 211. The orientation of the second opening is the same as the lighting direction of the LED street light 1.

Specifically, in the embodiment of the present invention, the shape of the first opening corresponds to that of the second opening, and both are quasi-rectangular. In other embodiments, the shapes of the first opening and the second opening may also be other shapes such as a circle or a polygon, as long as the shape of the first opening corresponds to that of the second opening.

The bottom wall 211 of the second accommodating slot 210 is the slot bottom of the second accommodating slot 210, and the side wall 212 of the second accommodating slot 210 is the slot wall of the second accommodating slot 210. The names "bottom wall" and "side wall" are merely used to distinguish the slot bottom 111 and the slot wall 112 of the first accommodating slot 110 for description.

The male joint 213 and the female joint 113 may be respectively fixed in the second accommodating slot 210 and the first accommodating slot 110 by means of bolts or the like.

In the first embodiment of the present invention, the first docking portion 11 and the second docking portion 21 are up-and-down docked, that is, the first docking portion 11 is engaged with the second docking portion 21 downward from above the second docking portion 21. After the first docking portion 11 is engaged with the second docking portion 21, the second docking portion 21 located below the first docking portion 11 can support the first docking portion 11, which can reduce the burden on the installer and improve the installation convenience. In other embodiments, the cooperation between the first docking portion 11 and the second docking portion 21 may also be straight-inserting, left-right docking, rotating buckle, etc. For example, one of the first docking portion 11 and the second docking portion 21 may be inserted into the other; or the first docking portion 11 is engaged with the second docking portion 21 from the left or right side of the second docking portion 21; or a first locking member is provided on the first docking portion 11 and a second locking member that cooperates with the first locking member is arranged on the second docking portion 21, when the first docking portion 11 is docked with the second docking portion 21, the first docking portion 11 is rotated to make the first locking member cooperate with the second locking member such that the first docking portion 11 and the second docking portion 21 are fixed.

Further, a clamping slot 214 is defined at the side, close to the first docking portion 11, of the four side walls 212 of the second accommodating slot 210. During the installation of the LED street light 1, after the first docking portion 11 is docked with the second docking portion 21, the four slot walls 112 of the accommodating slot 110 enter the clamping slot 214, and the first opening and the second opening are matched and docked, such that the first opening of the first accommodating slot 110 covers the second opening of the second accommodating slot to form a closed space. The male joint 213 and the female joint 113 are protected in the closed space, and the safety of the male joint 213 and the female joint 113 is improved.

Optionally, the clamping slot 214 may also be defined on the four slot wall 112 of the first accommodating slot 110, and after the first docking portion 11 is docked with the second docking portion 21, the side walls 212 of the second accommodating slot 210 enter the clamping slot 214 such that the second opening covers the first opening to form a closed space, and the male joint 213 and the female joint 113 are protected in the closed space.

After the first docking portion 11 is docked with the second docking portion 21, the second docking portion 21 and the first docking portion 11 cover each other to seal and protect the first accommodating slot 110 and the second accommodating slot 210 to improve the stability of the overall structure thereof.

The orientation of the first opening may also not be different from the lighting direction of the LED street light 1, and the orientation of the second opening may also be different from the lighting direction of the LED street light 1, as long as the orientation of the first opening is opposite to the orientation of the second opening and the first opening and the second opening are docked to form a closed space after the first docking portion 11 is docked with the second docking portion 21.

Further, due to the LED street light 1 being exposed to the air for a long time during use, the LED street light 1 will be in contact with water vapor in the air in the evening and in the early morning when the air humidity is high; and when it rains, the LED street light 1 is directly exposed to the rainwater, in which case water leakage is likely to occur at the docking portion of the first docking portion 11 and the second docking portion 21. Therefore, in order to prevent water vapor in the air and rainwater from affecting the performance of the LED street light 1, a waterproof ring 215 is provided between the first accommodating slot 110 and the second accommodating slot 210. Specifically, in the embodiment of the present invention, the waterproof ring 215 is disposed in the clamping slot 214. Thus, water vapor and rainwater can be prevented from affecting the male joint 213 and the female joint 113, which is beneficial to improve the service life of the LED street light 1.

Further, in order to improve the waterproof performance of the waterproof ring 215, the waterproof ring 215 is in an interference fit with the clamping slot 214.

Further, the thickness of the waterproof ring 215 is less than the depth of the clamping slot 214. Thus, when the clamping slot 214 is defined on the four side walls 212 of the second accommodating slot 210, there is still enough space in the clamping slot 214 with the first waterproof ring 215 disposed therein to accommodate the four slot walls 112 of the first accommodating slot 110. Similarly, when the clamping slot 214 is defined on the four slot walls 112 of the first accommodating slot 110, there is still enough space in the clamping slot 214 with the first waterproof ring 215 disposed therein to accommodate the four side walls 212 of the second accommodating slot 210. Thus, the waterproof performance of the LED street light 1 can be greatly improved.

Referring to FIGS. 2 to 5 again, in order to improve the precise and stable connection between the first docking portion 11 and the second docking portion 21 when installing the LED street light 1, two limiting members 117 are respectively provided at two opposite sides outside the first accommodating slot 110, and two limiting slots 217, that cooperate with the limiting members 117, are respectively defined at two opposite sides outside the second accommodating slot 210. A limiting wall 218 is provided at one side of the limiting slot 217, and the limiting wall 218 extends along the limiting slot 217 toward the first docking portion 11. During the installation of the LED street light 1, when the first docking portion 11 is docked with the second docking portion 21, the limiting member 117 enters the limiting slot 217 along the inner surface of the limiting wall 218.

Further, the first docking portion 11 is also provided with a limiting plate 114, and a limiting opening 115 is defined between the limiting plate 114 and the limiting member 117. During the installation of the LED street light 1, when the first docking portion 11 is docked with the second docking portion 21, the limiting wall 218 enters the limiting opening 115 to achieve precise positioning thereof.

Further, an abutting portion 216 is defined on the edge, formed by the bottom wall 211 extending in a direction away from the second accommodating slot 210, of the bottom wall 211, and the slot bottom 111 of the first accommodating slot 110 extends along a direction away from the first accommodating slot 110 such that there is a distance formed between the edge of the slot bottom 111 and the slot wall 112. During the installation of the LED street light 1, when the first docking portion 11 is docked with the second docking portion 21, the force acting on the main body 20 makes the second docking portion 21 approach the first docking portion 11 such that the second docking portion 21 and the first docking portion 11 are docked. When the abutting portion 216 of the second docking portion 21 abuts against the edge of the slot bottom 111 of the first docking portion 11, the second docking portion 21 cannot continue to move in the force-applying direction, thus the docking of the second docking portion 21 and the first docking portion 11 is completed.

Specifically, the slot bottom 111 is substantially rectangular, and the slot bottom 111 has four edges. One of the four edges is connected to the limiting plate 114, and the abutting portion 216 abuts the other three edges thereof except the edge connected to the limiting plate 114.

Figure 5:
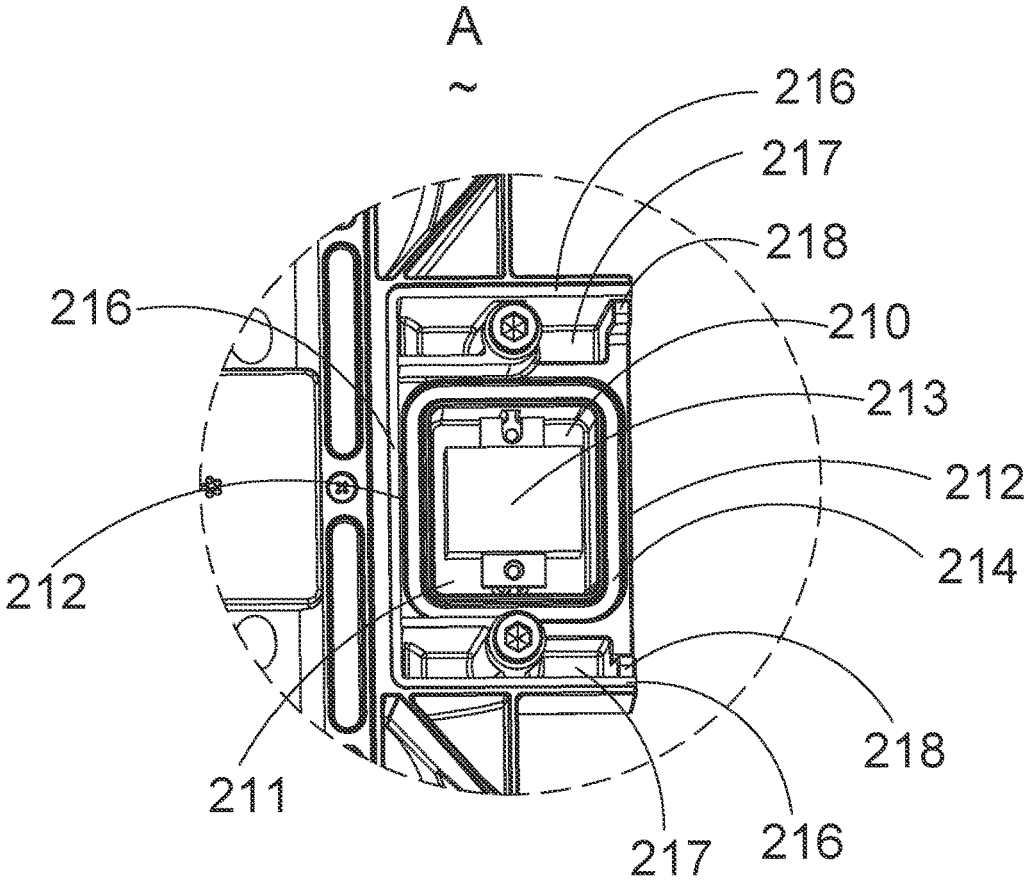
FIG. 5 is an enlarged view of A in FIG. 4.
Figure 6:
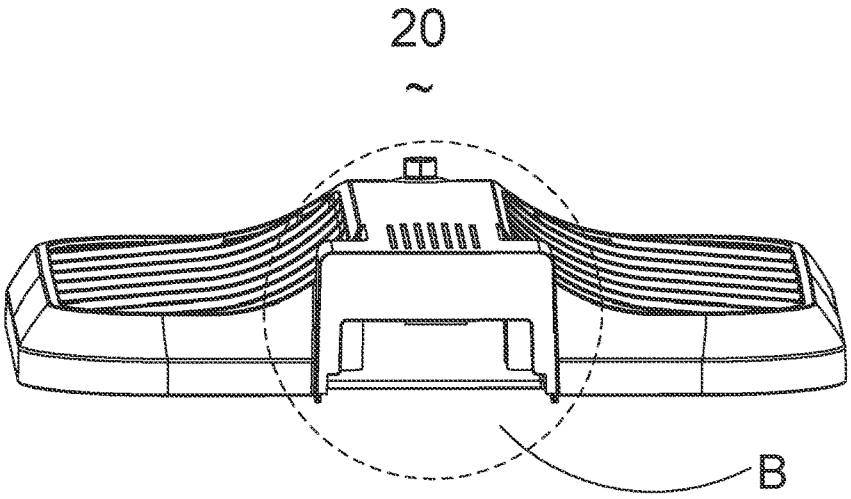
FIG. 6 is a perspective view of the main body of the LED street light of the first embodiment of the present invention.
Figure 7:
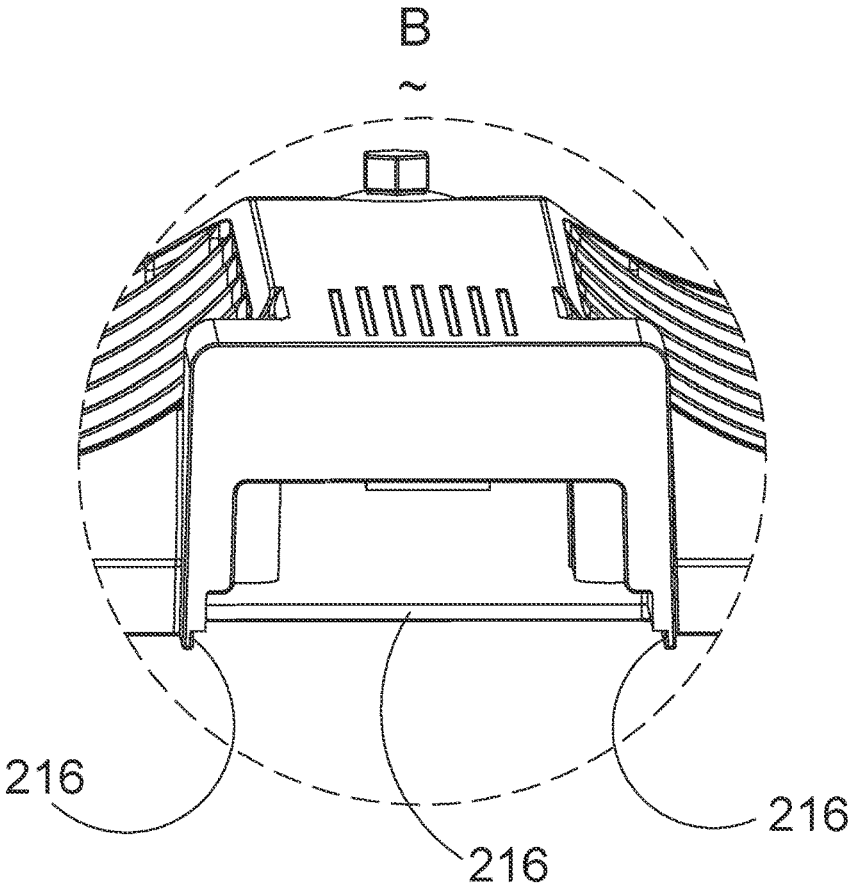
FIG. 7 is an enlarged view of B in FIG. 6.

Specifically, as shown in FIGS. 5 and 7, the abutting portion 216 is substantially U-shaped, and the cross-section of the abutting portion 216 is L-shaped.

When installing the LED street light 1, the docking process of the first docking portion 11 and the second docking portion 21 is: first, fix the support arm 10; second, move the main body 20 to the top of the support arm 10 to align the second docking portion 21 with the first docking portion 11; third, move the main body 20 downward. During the movement of the main body 20, the limiting member 117 enters the limiting slot 217 along the inner surface of the limiting wall 218, and the limiting wall 218 enters the limiting opening 115 at the same time. When the abutting portion 216 of the second docking portion 21 abuts against the edge of the slot bottom 111 of the first accommodating slot 110, the main body 20 cannot continue to move downward, thus the docking of the first docking portion 11 and the second docking portion 21 is completed.

The cooperation between the limiting member 117 and the limiting slot 217, the cooperation between the limiting wall 218 and the limiting opening 115, and the cooperation between the abutting portion 216 and the edge of the slot bottom 111 of the first accommodating slot 110 all play the role of positioning and stability effect, which makes the docking process of the first docking portion 11 and the second docking portion 21 simple and easy. In addition, the position of the female joint 113 in the first accommodating slot 110 and the position of the male joint 213 in the first accommodating slot 110 may be calculated in advance, such that the female joint 113 and the male joint 213 can be accurately and mutually inserted after the first docking portion 11 is docked with the second docking portion 21, without keeping an eye to observe the positions thereof to align the two joints.

The number, position and shape of the limiting member 117, the limiting slot 217, the limiting wall 218 and the limiting opening 115 are not limited, as long as the above-mentioned cooperation can be achieved.

Further, the first docking portion 11 defines bolt holes 140 on two opposite sides outside the first accommodating slot 110, and the second docking portion 21 correspondingly defines matching portions matched with the bolt holes 140. After the first docking portion 11 and the second docking portion 21 are docked, the bolt holes 140 and the matching portion are fixed by means of bolts, thus the stability of the LED street light 1 is enhanced.

The positions and numbers of the bolt holes 140 may be changed according to actual products.

Compared with the prior art, the LED street light of the present invention has the following beneficial effects.

The LED street light of the present invention includes a main body and a support arm connected to the main body; a female joint is provided at one end of the support arm close to the main body, and a male joint is provided at one end of the main body close to the support arm; when installing the LED street light, the male joint and the female joint are mutually inserted to achieve an electrical connection therebetween; when installing the LED street light, the male joint and the female joint are mutually inserted to supply power to the main body, without arranging the circuits in the LED street light before installation, which greatly simplifies the installation process, reduces the installation time and the installation difficulty; in addition, due to the reducing of the installation time and installation difficulty, the safety hazards caused by the installation of the LED street lights can also be prevented; furthermore, when the LED street light needs to be repaired or maintained, it is simpler and more convenient to disassemble the main body, which saves manpower and is safer.

A first docking portion is provided at one end of the support arm close to the main body, the first docking portion defines a first accommodating slot with an opening, and the female joint is disposed in the first accommodating slot; a second docking portion docked with the first docking portion is provided at one end of the main body close to the support arm, the second docking portion defines a second accommodating slot with an opening, and the male joint is disposed in the second accommodating slot; when the first docking portion is docked with the second docking portion, the opening of the first accommodating slot is matched and docked with the opening of the second accommodating slot.

The female joint is disposed in the first accommodating slot, which can protect and centrally manage the female joint, improve the safety of the female joint, and facilitate the maintenance of the female joint; the male joint is disposed in the second accommodating slot, which can protect and centrally manage the male joint, improve the safety of the male joint, and facilitate the maintenance of the male joint; in addition, after the first docking portion is docked with the second docking portion, the opening of the first accommodating slot matches the opening of the second accommodating slot to form a closed space to seal and protect the male joint and the female joint therein, such that the structure thereof is simple, stable and safe.

A clamping slot is defined on the slot wall of the first accommodating slot, when installing the LED street light, the side wall of the second accommodating slot enters the clamping slot such that the opening of the first accommodating slot is matched and docked with the opening of the second accommodating slot; or a clamping slot is defined on the side wall of the second accommodating slot, when installing the LED street light, the slot wall of the first accommodating slot enters the clamping slot such that the opening of the first accommodating slot is matched and docked with the opening of the second accommodating slot; the cooperation between the slot wall and the clamping slot can improve the sealing performance of the closed space formed after the opening of the first accommodating slot and the opening of the second accommodating slot are matched, such that the stability of the structure thereof is improved, and the safety of the male joint and the female joint is improved.

A waterproof ring is provided in the clamping slot of the present invention, which can further seal and protect the male joint and the female joint, such that when the LED street light is in use, the male joint and the female joint are completely isolated from the water vapor in the air, which further improves the stability of the structure thereof.

An abutting portion is defined on the edge formed by the bottom wall extending in a direction away from the second accommodating slot, and the slot bottom of the first accommodating slot extends along a direction away from the first accommodating slot such that there is a distance formed between the edge of the slot bottom and the slot wall; when installing the LED street light, the abutting portion abuts the edge of the slot bottom to limit the movement of the second docking portion, such that the main body can be positioned to improve the installation convenience thereof.

The abutting portion of the present invention is U-shaped, which can abut three edges of the slot bottom, such that the positioning thereof is accurate and stable.

In the present invention, two limiting members are respectively provided at two opposite sides outside the first accommodating slot, and two limiting slots, that cooperate with the limiting members, are respectively defined at two opposite sides outside the second accommodating slot; when installing the LED street light, the limiting member enters the limiting slot; the cooperation of the limiting member and the limiting slot can locate the connecting portion thereof when installing the LED street light, and can locate the insertion position of the male joint and the female joint, which further improves the convenience of installation.

One side of the limiting slot of the present invention is provided with a limiting wall, and a limiting plate is also provided on the first docking portion, and a limiting opening is defined between the limiting plate and the limiting member; when installing the LED street light, the limiting wall enters the limiting opening; the cooperation of the limiting wall and the limiting opening can achieve accurate positioning and improve the convenience of installation.

The support arm of the present invention includes a fixed arm and an adjusting arm detachably connected to the fixed arm, and the first docking portion is disposed on the adjusting arm; the lighting angle of the main body can be adjusted by adjusting the adjusting arm such that the operation is simple and convenient.

A first engaging portion and a dial are respectively provided on opposite sides of the adjusting arm, and a second engaging portion is provided on the fixed arm corresponding to the first engaging portion; the lighting angle of the LED street light can be changed by rotating the first engaging portion and/or the second engaging portion to adjust the matching position of the first engaging portion and the second engaging portion, and the lighting angle of the LED street light can be visually observed through the dial, such that the operation is easy and the structure is simple, which can further reduce the installation difficulty of the LED street light and meet the various lighting needs of the LED street light.

The above descriptions are merely preferred embodiments of the present invention and are not intended to limit the present invention. Any modifications, equivalent replacements and improvements made within the principles of the present invention should be included within the protection scope of the present invention.

What is claimed is:

1. A LED street light, comprising:

a main body;

a support arm connected to the main body;

a female joint disposed at one end of the support arm close to the main body;

a male joint disposed at one end of the main body close to the support arm;

wherein a first docking portion is disposed at one end of the support arm close to the main body; the first docking portion defining a first accommodating slot having an opening, and the female joint being disposed therein; a second docking portion, which is docked with the first docking portion, being disposed at one end of the main body close to the support arm; the second docking portion defining a second accommodating slot having an opening, and the male joint being disposed therein;

a clamping slot is defined on a slot wall of the first accommodating slot: or two limiting members are respectively disposed at two opposite sides outside the first accommodating slot, and two limiting slots that cooperate with the limiting members are respectively defined at two opposite sides outside the second accommodating slot; when installing the LED street light, the side wall of the second accommodating slot enters the clamping slot or the limiting members entering the limiting slots, such that the opening of the first accommodating slot is matched and docked with the opening of the second accommodating slot to make the male joint and the female joint being mutually inserted to achieve an electrical connection therebetween.

2. The LED street light of claim 1, wherein the shape of the opening of the first accommodating slot corresponds to that of the opening of the second accommodating slot.

3. The LED street light of claim 1, wherein when the first docking portion is docked with the second docking portion, the opening of the first accommodating slot is matched and docked with the opening of the second accommodating slot.

4. The LED street light of claim 1, wherein the orientation of the opening of the first accommodating slot is opposite to the lighting direction of the LED street light, and the orientation of the opening of the second accommodating slot is the same as the lighting direction of the LED street light.

5. The LED street light of claim 1, wherein when the first docking portion is docked with the second docking portion, the first docking portion is inserted into the second docking portion or the second docking portion is inserted into the first docking portion.

6. The LED street light of claim 1, wherein a waterproof ring is disposed between the first accommodating slot and the second accommodating slot.

7. The LED street light of claim 1, wherein a waterproof ring is disposed in the clamping slot.

8. The LED street light of claim 7, wherein the waterproof ring is in an interference fit with the clamping slot.

9. The LED street light of claim 7, wherein the thickness of the waterproof ring is less than the depth of the clamping slot.

10. The LED street light of claim 1, wherein an abutting portion is defined on an edge formed by a bottom wall of the second accommodating slot that extends in a direction away from the second accommodating slot, and a slot bottom of the first accommodating slot extends along a direction away from the first accommodating slot such that there is a distance formed between an edge of the slot bottom of the first accommodating slot and the slot wall of the first accommodating slot; during the installation of the LED street light, the abutting portion abutting the edge of the slot bottom of the first accommodating slot to limit the movement of the second docking portion.

11. The LED street light of claim 1, wherein the abutting portion is U-shaped.

12. The LED street light of claim 1, wherein the cross-section of the abutting portion is L-shaped.

13. The LED street light of claim 1, wherein a limiting wall is disposed at one side of the limiting slot, a limiting plate is disposed at the first docking portion, and a limiting opening is defined between the limiting plate and the limiting member; when installing the LED street light, the limiting wall entering the limiting opening.

14. The LED street light of claim 1, wherein the support arm comprises an adjusting arm and a fixed arm detachably connected to the adjusting arm; the first docking portion being disposed on the adjusting arm, and the adjusting arm being used for adjusting the lighting angle of the LED street light.

15. The LED street light of claim 14, wherein a first engaging portion is disposed at one side of the adjusting arm, and a second engaging portion is disposed on the fixed arm corresponding to the first engaging portion; the lighting angle of the LED street light can be changed by rotating the first engaging portion and/or the second engaging portion to adjust the matching position of the first engaging portion and the second engaging portion.

16. The LED street light of claim 15, wherein a dial is disposed on one side, opposite to the first engaging portion, of the adjusting arm, and the dial is used for illustrating the lighting angle of the LED street light.

17. The LED street light of claim 1, wherein the first docking portion defines bolt holes on two opposite sides outside the first accommodating slot, and the second docking portion correspondingly defines matching portions matched with the bolt holes; after the first docking portion and the second docking portion are docked, the bolt holes and the matching portion can be fixed by means of bolts to connect the first docking portion with the second docking portion.

* * * * *